US008496278B2

(12) United States Patent
Lee

(10) Patent No.: US 8,496,278 B2
(45) Date of Patent: Jul. 30, 2013

(54) PORTABLE DEVICE FOR PREVENTING MOVEMENT OF A DOOR

(76) Inventor: Deborah Anne Hong Lan Lee, Hong Kong (HK)

( * ) Notice: Subject to any disclaimer, the term of this patent is extended or adjusted under 35 U.S.C. 154(b) by 0 days.

(21) Appl. No.: 13/077,318

(22) Filed: Mar. 31, 2011

(65) Prior Publication Data

US 2011/0278866 A1 Nov. 17, 2011

(30) Foreign Application Priority Data

May 11, 2010 (HK) ..... 10104562.8

(51) Int. Cl.
*E05C 17/54* (2006.01)
*E05C 17/44* (2006.01)

(52) U.S. Cl.
USPC ..... 292/339; 292/DIG. 15; 16/82

(58) Field of Classification Search
USPC ..... 292/262, 276, 288–298, 338, 339, 292/342, 343, DIG. 15, DIG. 44, DIG. 60; 16/82, 83, 85; 248/351; 49/394
See application file for complete search history.

(56) References Cited

U.S. PATENT DOCUMENTS

| | | | | | |
|---|---|---|---|---|---|
| 282,132 | A | * | 7/1883 | Thurzo | 135/86 |
| 544,730 | A | * | 8/1895 | Kennedy | 292/338 |
| 587,131 | A | * | 7/1897 | Markert | 292/140 |
| 921,765 | A | * | 5/1909 | Whitaker | 292/153 |
| 984,959 | A | * | 2/1911 | Moran | 292/181 |
| 1,035,298 | A | * | 8/1912 | Aspegren | 16/82 |
| 1,044,728 | A | * | 11/1912 | Basler | 292/338 |
| 1,238,042 | A | * | 8/1917 | Moore | 292/139 |
| 1,590,394 | A | * | 6/1926 | Rawlings | 292/182 |
| 1,876,173 | A | * | 9/1932 | Sasgen | 292/338 |
| 2,097,349 | A | * | 10/1937 | Sladek | 292/338 |
| 2,121,490 | A | * | 6/1938 | Sasgen et al. | 292/338 |
| 2,194,510 | A | * | 3/1940 | Sasgen | 292/338 |
| 2,462,662 | A | * | 2/1949 | Niceley | 248/351 |
| 2,762,641 | A | * | 9/1956 | Gilmour | 292/63 |
| 2,774,622 | A | * | 12/1956 | Priebe | 292/288 |
| 4,759,577 | A | * | 7/1988 | Thomas, III | 292/338 |
| 4,819,296 | A | * | 4/1989 | Wilkins | 16/82 |
| 5,135,273 | A | * | 8/1992 | MacCalder | 292/338 |
| 5,217,268 | A | * | 6/1993 | MacCalder | 292/338 |
| 5,217,269 | A | | 6/1993 | Wiltberger | |
| 5,286,075 | A | * | 2/1994 | Monzingo | 292/339 |
| 5,601,319 | A | * | 2/1997 | Morin | 292/139 |
| 5,673,952 | A | * | 10/1997 | Chezem et al. | 292/338 |
| 6,120,072 | A | * | 9/2000 | Benedict | 292/338 |
| 6,651,295 | B2 | * | 11/2003 | Hodson | 16/85 |
| 7,017,229 | B2 | * | 3/2006 | Walcome | 16/82 |

(Continued)

FOREIGN PATENT DOCUMENTS

| | | |
|---|---|---|
| CH | 312096 | 2/1956 |
| CN | 200985698 Y | 12/2007 |
| WO | WO 2006/136438 A1 | 12/2006 |

*Primary Examiner* — Carlos Lugo
*Assistant Examiner* — Alyson M Merlino
(74) *Attorney, Agent, or Firm* — Muncy, Geissler, Olds & Lowe, PLLC

(57) ABSTRACT

A portable device (10) for preventing movement of a door (5), the device (10) comprising: a support frame (11) having a base portion (12); and a leg (20) connected to the support frame (11); wherein the leg (20) is adjustable in height such that a distal end of the leg (20) is made to contact the ground when at least part of the base portion (12) is inserted beneath the door (5) in order to prevent movement of the door (5).

6 Claims, 11 Drawing Sheets

U.S. PATENT DOCUMENTS

| | | | | |
|---|---|---|---|---|
| 7,065,830 | B2 * | 6/2006 | Bushey | 16/82 |
| 7,937,806 | B1 * | 5/2011 | Doyle | 16/82 |
| 2004/0070217 | A1 | 4/2004 | Demlow et al. | |
| 2007/0044274 | A1 * | 3/2007 | Chen et al. | 16/82 |
| 2008/0307604 | A1 * | 12/2008 | Leung | 16/82 |
| 2008/0309100 | A1 | 12/2008 | Ollinger | |
| 2009/0139050 | A1 * | 6/2009 | Junkins | 16/84 |

* cited by examiner

PORTABLE DEVICE FOR PREVENTING MOVEMENT OF A DOOR

This nonprovisional application claims priority under 35 U.S.C. §119(*a*) to Hong Kong Patent Application No. 10104562.8, which was filed in Hong Kong on May 11, 2010, and which is herein incorporated by reference.

TECHNICAL FIELD

The invention concerns a portable device for preventing movement of a door.

BACKGROUND OF THE INVENTION

A wedge or a kick-stand stopper may be used to prevent a self-closing door from closing. The wedge is usually made of rubber or wood to provide some deformation and traction between the bottom of a door and the ground. After repeated uses, the material of the wedge generally deteriorates and the wedge becomes unusable. Sometimes the space between the bottom of the door and the ground is too high for the wedge to properly function. Typically, wedges must be stowed away when not in use otherwise they may become easily lost. Also, since wedges are relatively small (about palm sized), they are kicked into position by a foot and therefore become unhygienic to handle with hands.

Kick-stand stoppers are permanently mounted to a self-closing door. In hotels, restaurants and shopping centres where there are many self-closing doors, the cost of installing kick-stand stoppers for every self-closing door can be expensive.

Therefore, there is a desire for a portable device to prevent movement of a door that ameliorates some of the abovementioned problems.

SUMMARY OF THE INVENTION

In a first preferred aspect, there is provided a portable device for preventing movement of a door, the device comprising:

a support frame having a base portion; and a leg connected to the support frame;

wherein the leg is adjustable in height such that a distal end of the leg is made to contact the ground when at least part of the base portion is inserted beneath the door in order to prevent movement of the door.

The leg may have an upper portion and a lower portion, the upper portion being connected to the lower portion at an obtuse angle.

The angle may be about 154°.

The leg may be pivotally connected to the support frame at a pivot point, the leg being movable relative to the support frame about the pivot point.

The support frame may have an aperture such that at least the lower portion of the leg passes through the aperture by moving the leg towards the support frame into a retracted position.

The support frame may be "L" shaped.

The device may further comprise an integrated hook extending from the top of the support frame, the hook being coated with rubber to minimise scratching with an object that the hook is hung onto.

The lower portion of the leg may comprise a first component operatively attached a second component via a screw thread, and manual rotation of the second component relative to the first component adjusts the total height of the leg.

The leg and support frame may be made from stainless steel.

The distal end of the leg may be covered by a rubber foot to increase friction between the leg and the ground.

The rubber foot may have a plurality of rubber fins extending inwardly from the circumferential peripheral edge of the rubber foot to minimise movement of the rubber foot after the height of the leg has been adjusted.

BRIEF DESCRIPTION OF THE DRAWINGS

An example of the invention will now be described with reference to the accompanying drawings, in which.

DETAILED DESCRIPTION OF THE DRAWINGS

Figure 1:
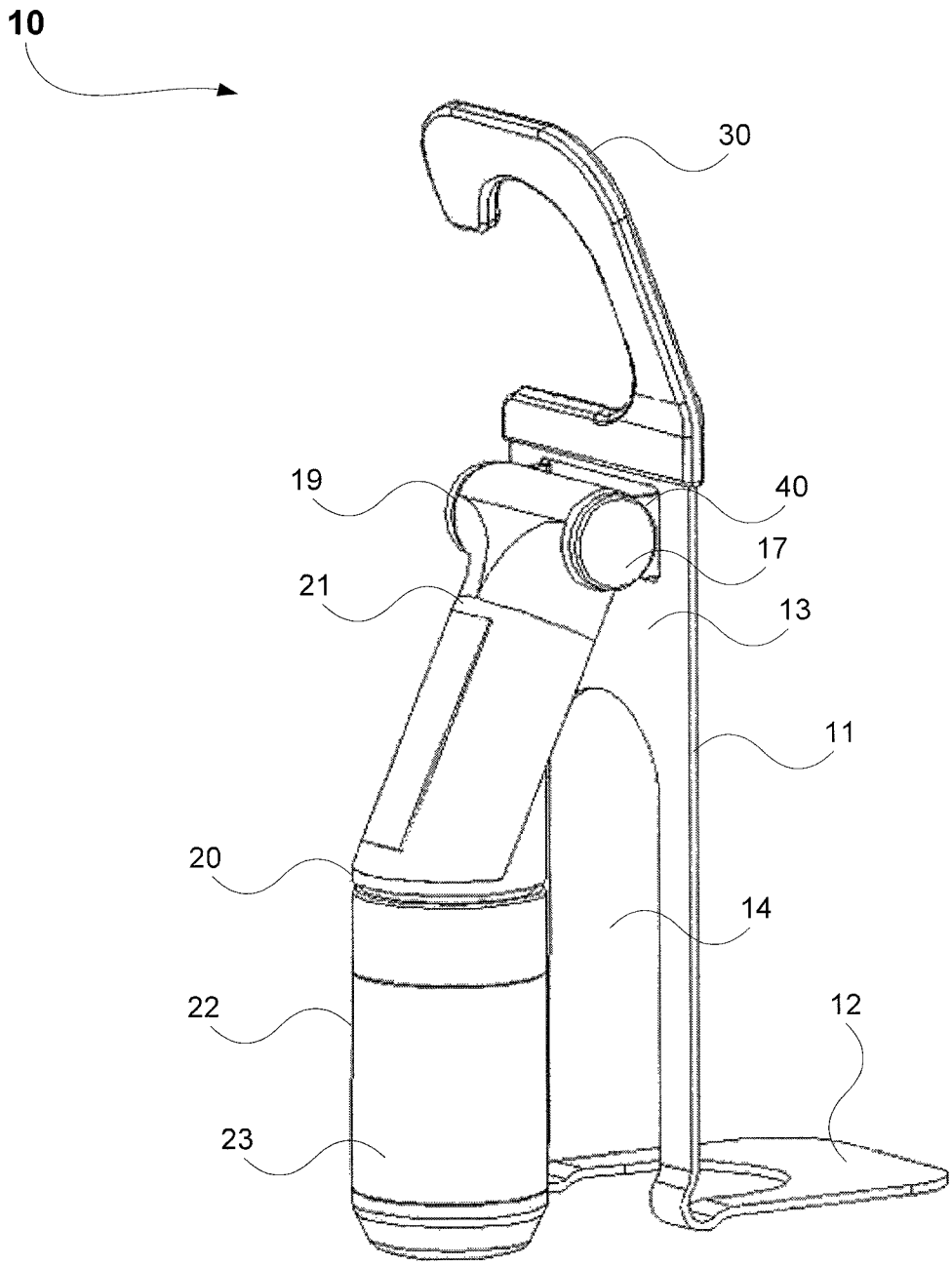
FIG. 1 is a perspective view of a portable device for preventing movement of a door in accordance with a preferred embodiment of the present invention.
Figure 2:
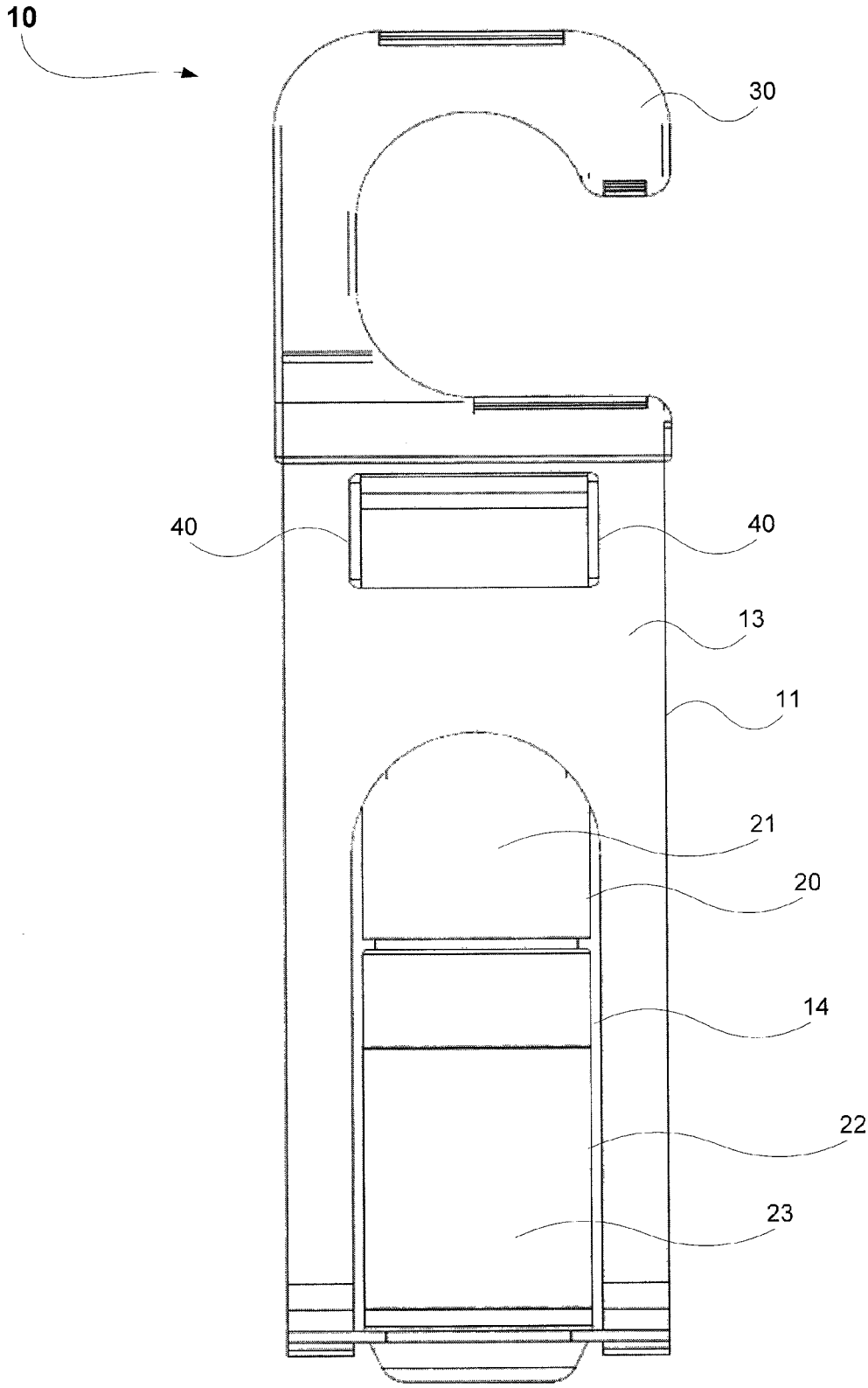
FIG. 2 is a rear view of the device of FIG. 1.
Figure 3:
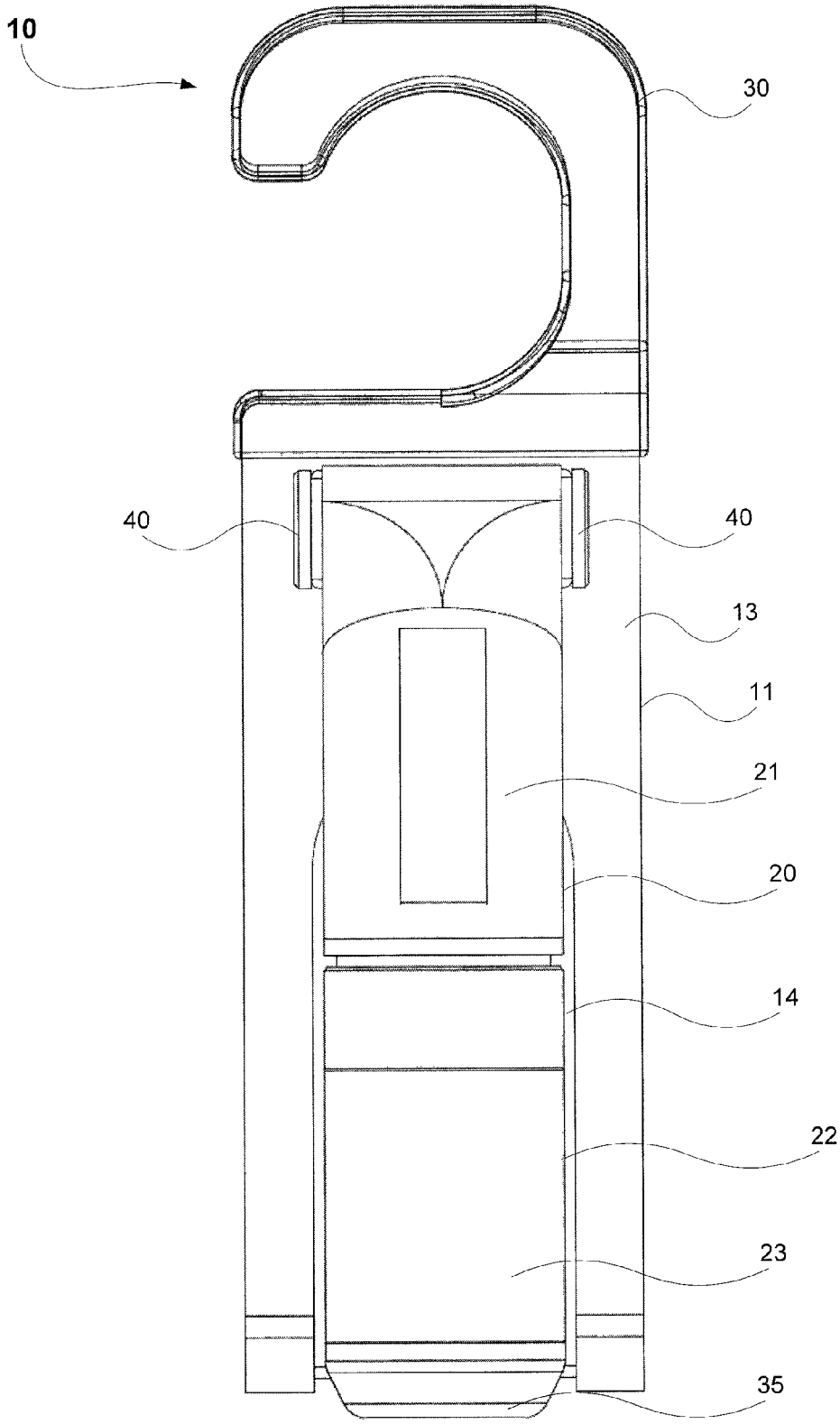
FIG. 3 is a front view of the device of FIG. 1.
Figure 4:
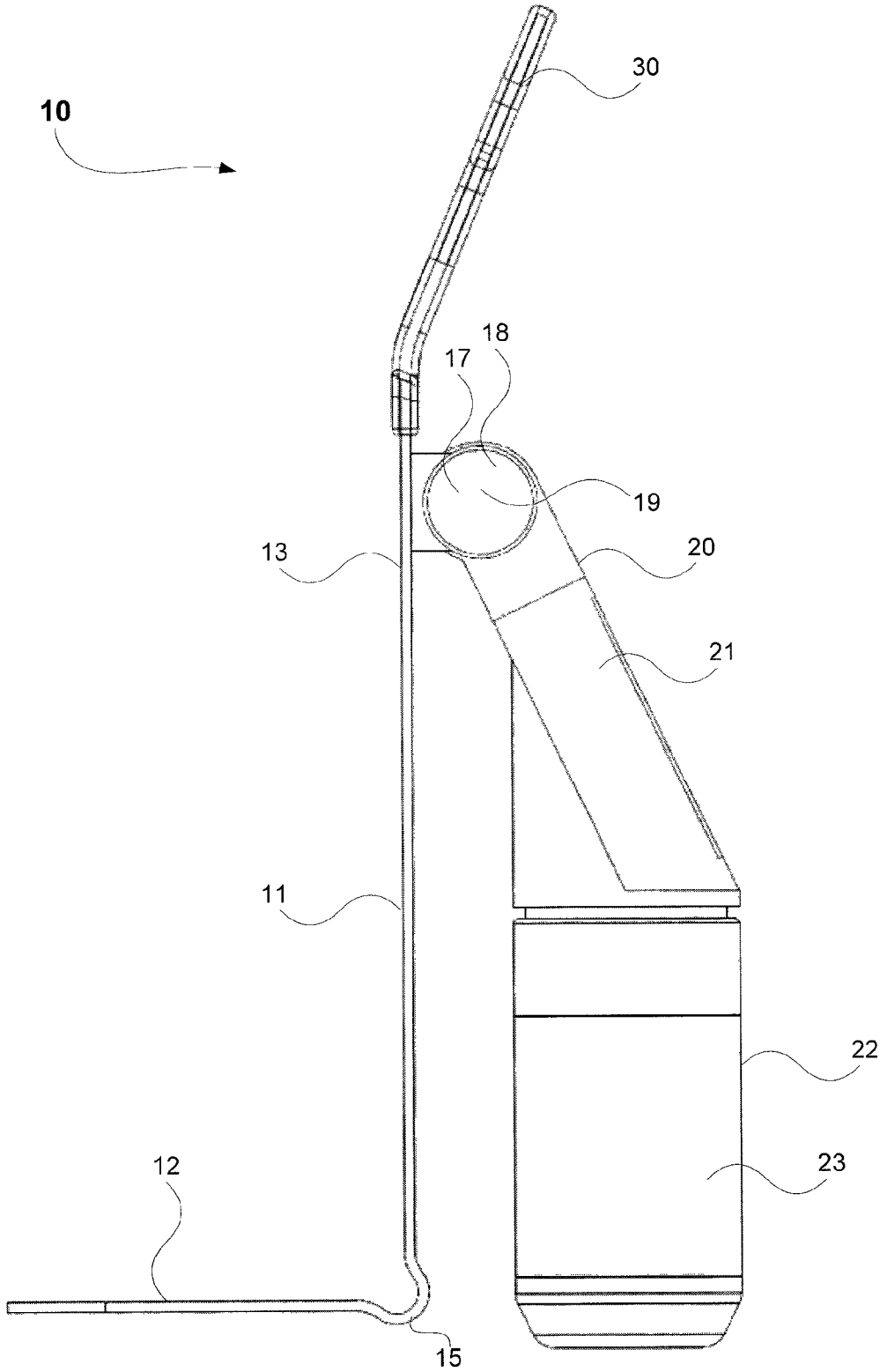
FIG. 4 is a left side view of the device of FIG. 1.
Figure 5:
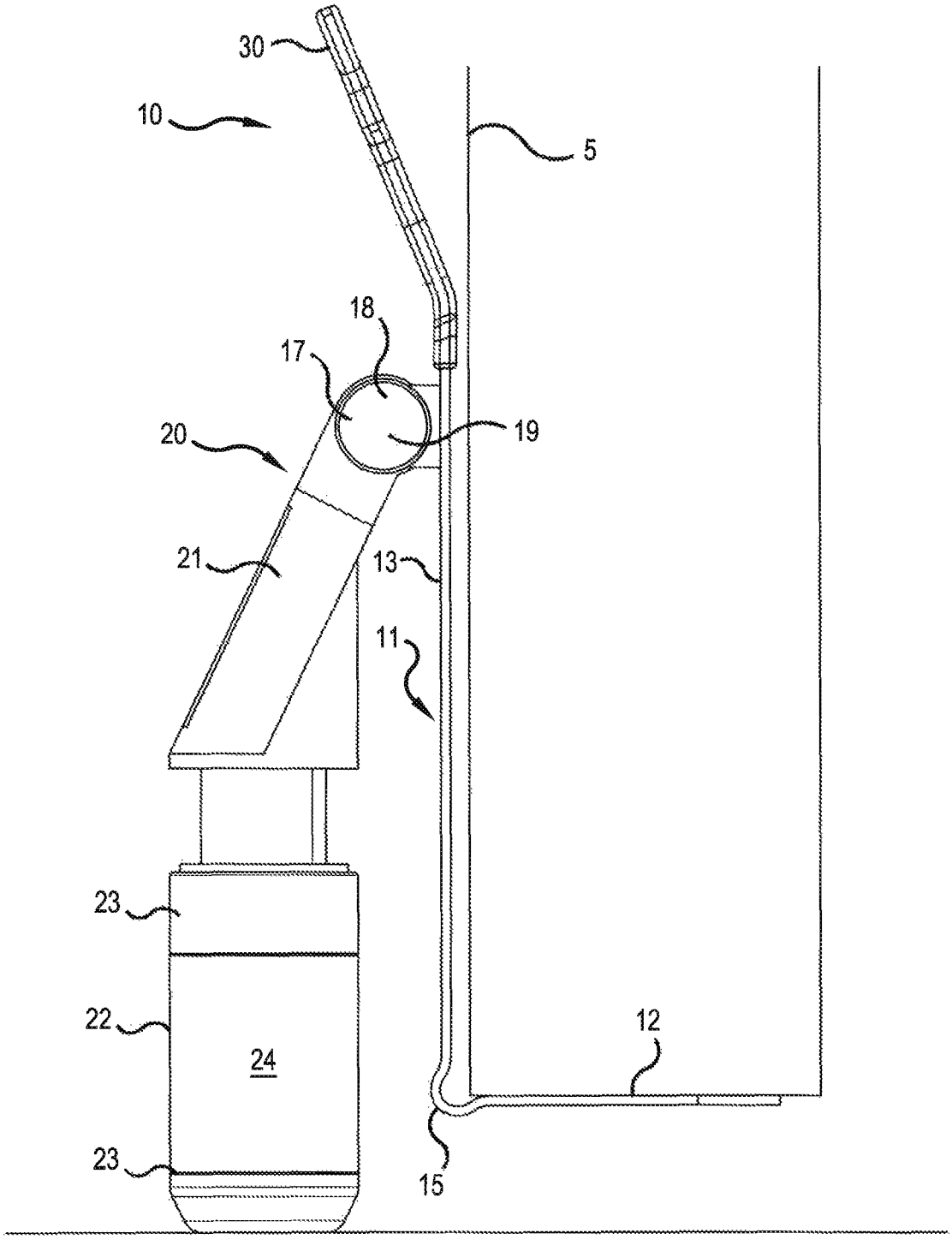
FIG. 5 is a right side view of the device of FIG. 1 inserted beneath a door.
Figure 6:
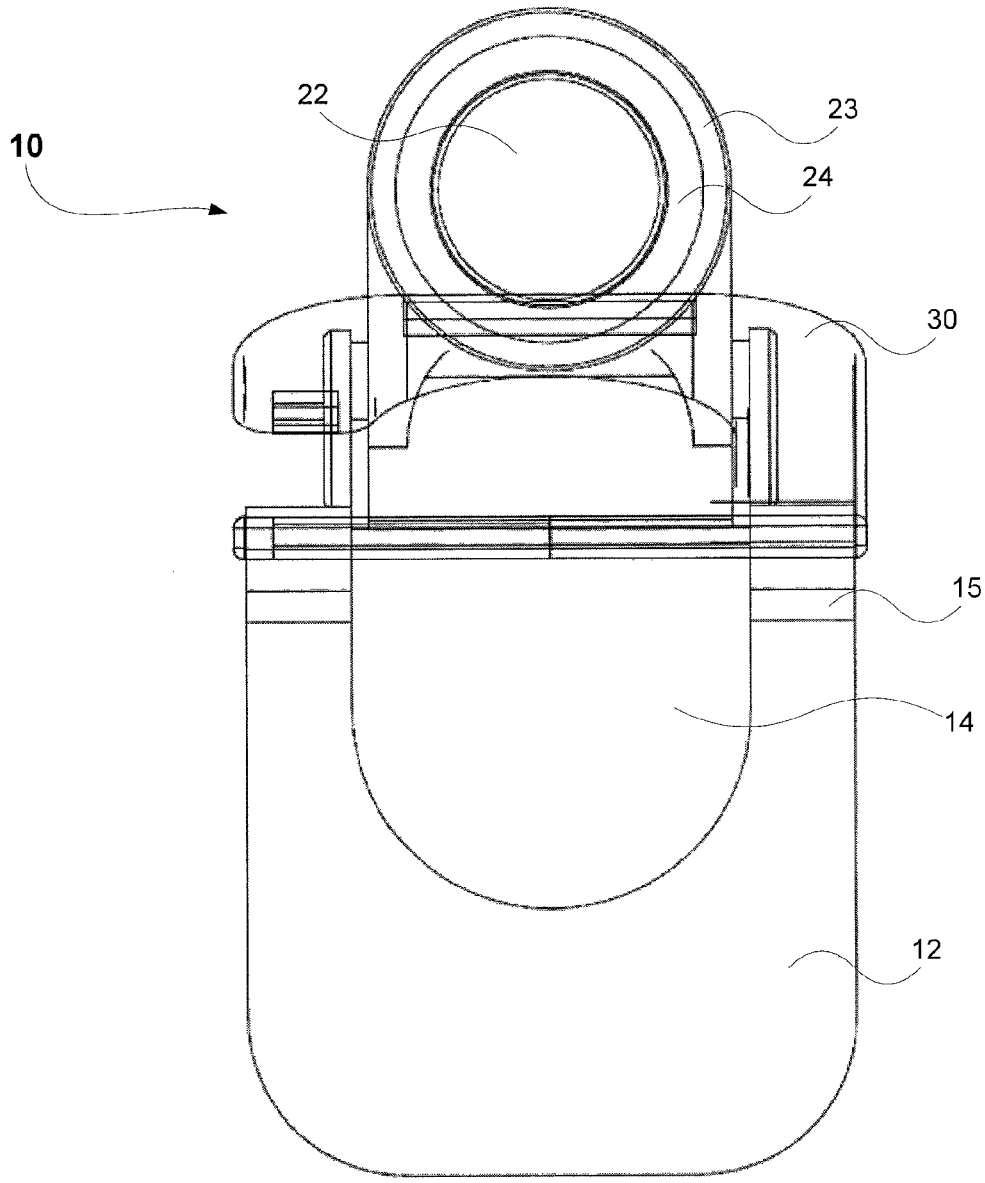
FIG. 6 is a bottom view of the device of FIG. 1.
Figure 7:
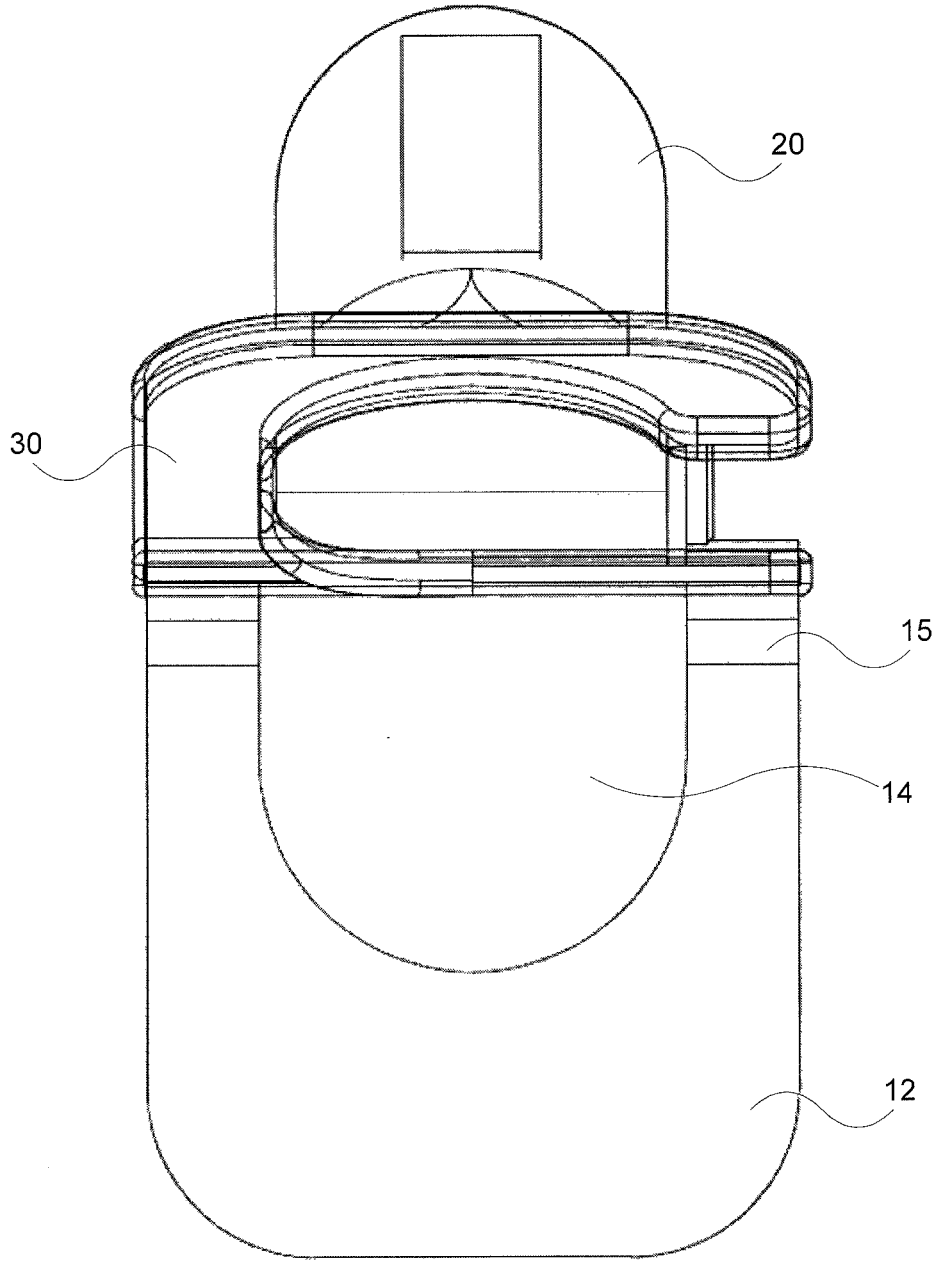
FIG. 7 is a top view of the device of FIG. 1.

Referring to the drawings, a portable device 10 for preventing movement of a door 5 is provided. The device 10 weighs 330 grams which is relatively light weight for easy carriage by users. The device 10 comprises an "L" shaped support frame or bracket 11 having a base portion 12. The support frame 11 is made as a single piece. A leg 20 is connected to the support frame 11. The leg 20 is adjustable in height such that a rubber foot 23 is made to engage the ground when at least part of the base portion 12 is inserted beneath the door 5 in order to prevent movement of the door 5. In use, the base portion 12 of the device 10 is slid under a door 5 until the vertical section 13 of the support frame 11 abuts against the side of the door 5. The support frame 11 has a curved corner 15 joining the vertical section 13 to the base portion 12. This bent area is stress hardened to improve the overall strength and durability of the device 10. The entire support frame 11 is strengthened by this deformation also. The leg 20 is made as a single piece and comprises a die-cast upper part 21 and a die-cast lower part 22. The lower part 22 is at an obtuse angle relative to the upper part 21. Preferably, the obtuse angle is about 154°.

Figure 8:
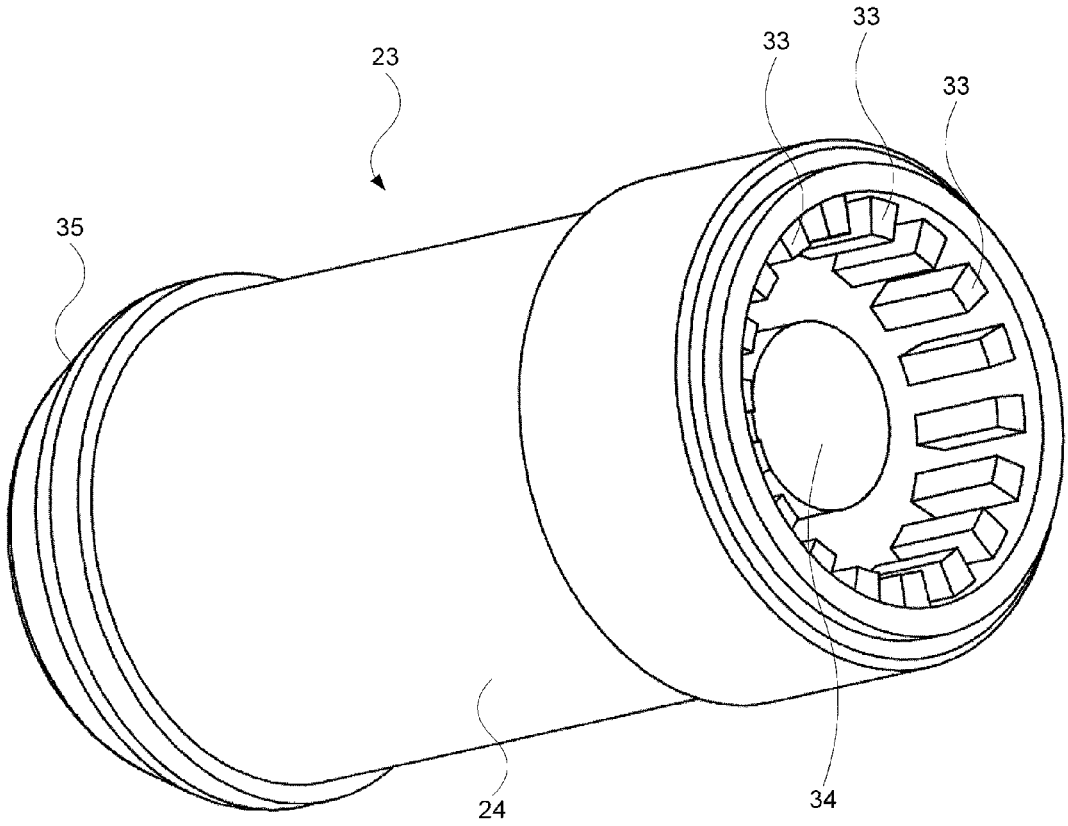
FIG. 8 is a perspective view of a rubber foot of the device of FIG. 1.
Figure 9:
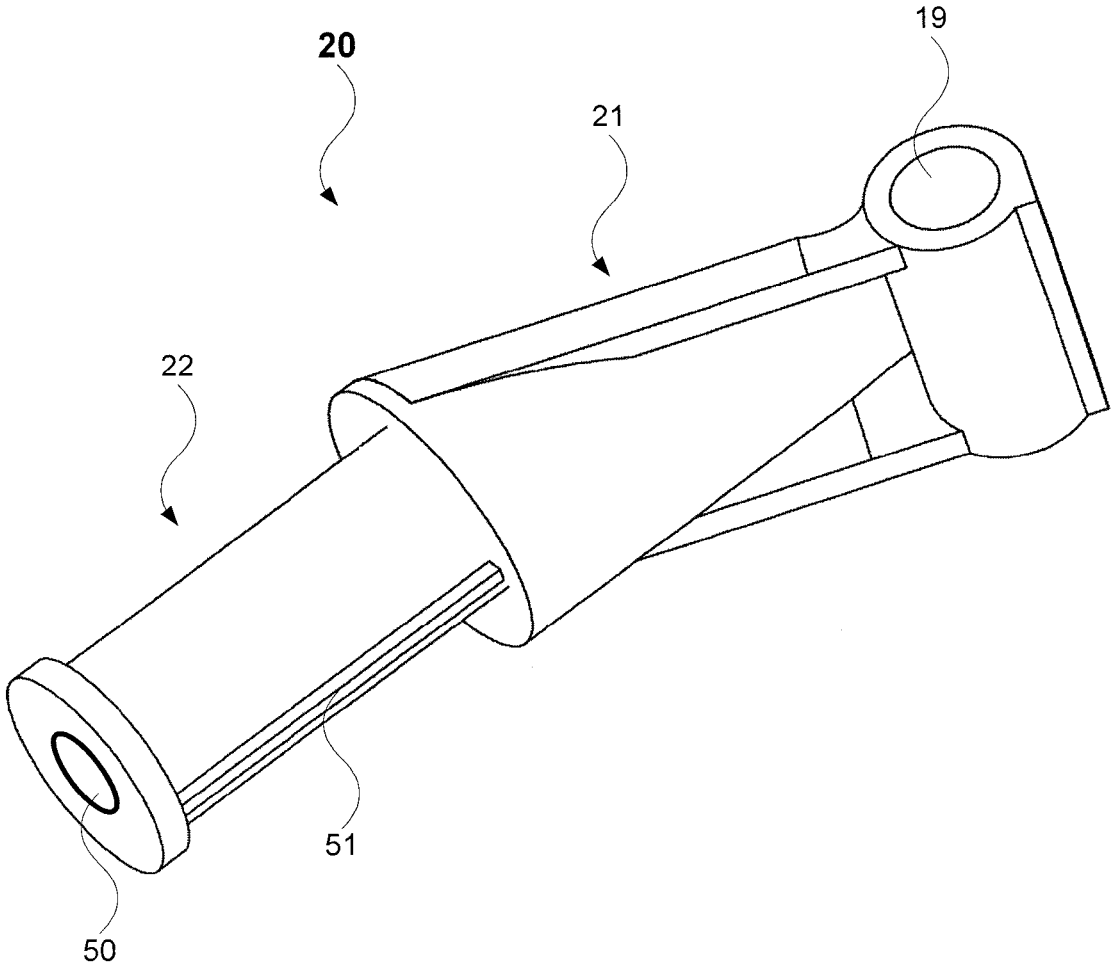
FIG. 9 is a perspective view of a leg of the device of FIG. 1 without the rubber foot.

Turning to FIG. 8, the rubber foot 23 is attached to the lower part 22 of the leg 20 including the distal end 21 of the leg 20 with a 40 mm screw 34 embedded in it which cooperates with a 25 mm screw nut 50 welded into the lower part 22 of the leg 20. The rubber foot 23 provides gripping for the device 10 on any ground surface. The screw nut 50 is welded into a hollow chamber extending from the bottom of the lower part 22. The screw nut 50 works with the 40 mm screw 34 embedded into the rubber foot 23 to allow the height of the leg 20 to be adjusted. The screw nut 50 is used to create a tighter (deeper) housing for the screwed-in rubber foot 23 to create greater stability. The rubber foot 23 is also adjustable and works well with any gap height between any door 5 and floor. The rubber foot 23 is 54.3 mm in height with a diameter of 28.0 mm.

Figure 10:
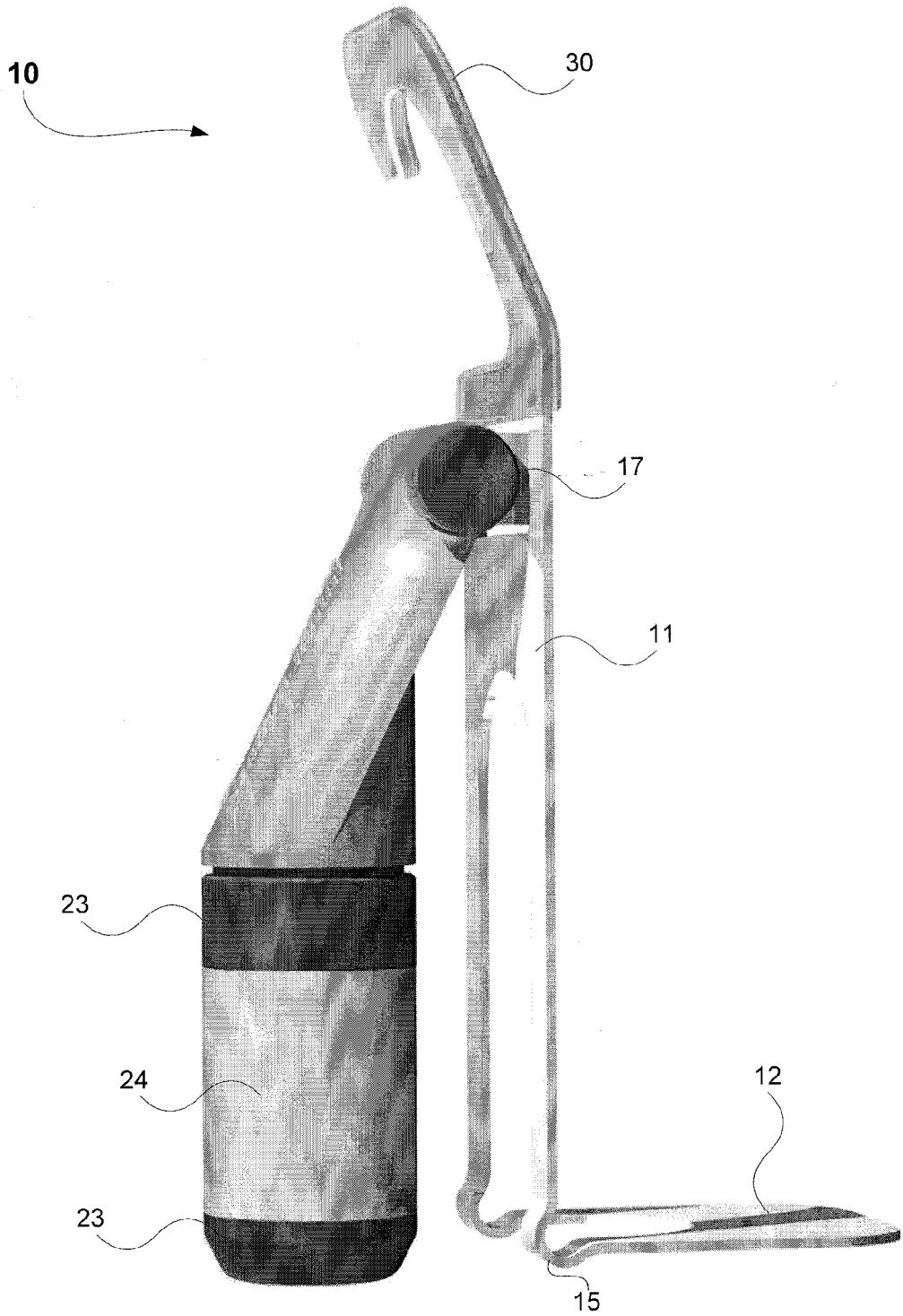
FIG. 10 is perspective view of the device of FIG. 1 with shading.

FIG. 10 shows clearly that a stainless steel tube 24 fits over the rubber foot 23 like a sleeve. The tube 24 is gripped or actuated by a user which is more aesthetically pleasing and hygienic than directly contacting the rubber foot 23 which regularly contacts the ground surface. Manual rotation of the rubber foot 23 relative to the lower part 22 of the leg 20 increases the height of the leg 20. The leg 20 is extended via the foot 23 by manually rotating the tube 24 anti-clockwise. The height of the leg 20 is adjusted so that the rubber foot 23 is in contact with the ground to provide frictional resistance and prevent the door 5 from moving. Rubber fins 33 are provided which are part of the cast of the rubber foot 23. The rubber fins 23 works against a single rail 51 that runs along the length of the lower part 22 of the leg 20 causing some friction that prevents the rubber foot 23 from losing its set height (after a desired height is reached by rotating the foot 23 up (clockwise) or down (anti-clockwise). User-selectable height adjustment is provided by the device 10 to address problems of different gap heights between various doors and floor surfaces. To make the device 10 more effective in stopping the movement of a door 5, especially a heavy door with a slippery ground surface, an optimal angle between the leg 20 and the support frame 11 is required. This optimal angle is determined by adjusting the rubber foot 23 up or down. The effectiveness of the rubber foot 23 to grip the floor surface is also related to the material used for the foot 23. A rubber material is selected and a dimple/concave design at the bottom of the rubber foot 23 allows the thickest part of the rubber foot 23 (i.e. the bottom radius) to make contact with the ground surface to provide greater traction. One form for the rubber foot 23 is to have a chamfered edge 35. During use, the chamfered edge 35 is the most likely portion of the rubber foot 23 that makes direct contact with the ground surface.

The leg 20 is pivotally connected to the support frame 11 at a pivot point 19. The leg 20 is movable relative to the support frame 11 about the pivot point 19. A 8.0 mm stainless steel tube 18 extends laterally at the top of the upper part of the leg 20 proximal to the pivot point 19. The support frame 11 has a pair of flanges 40 extending outwardly from the frame 11. The flanges 40 are positioned at about 100 mm high from the base portion 12. In each flange 40 is a side hole. The tube 18 is inserted through the side holes to connect the leg 20 to the support frame 11. Pivot end caps 17 are inserted into both ends of the tube 18 to conceal the inserted tube 18.

Figure 11:
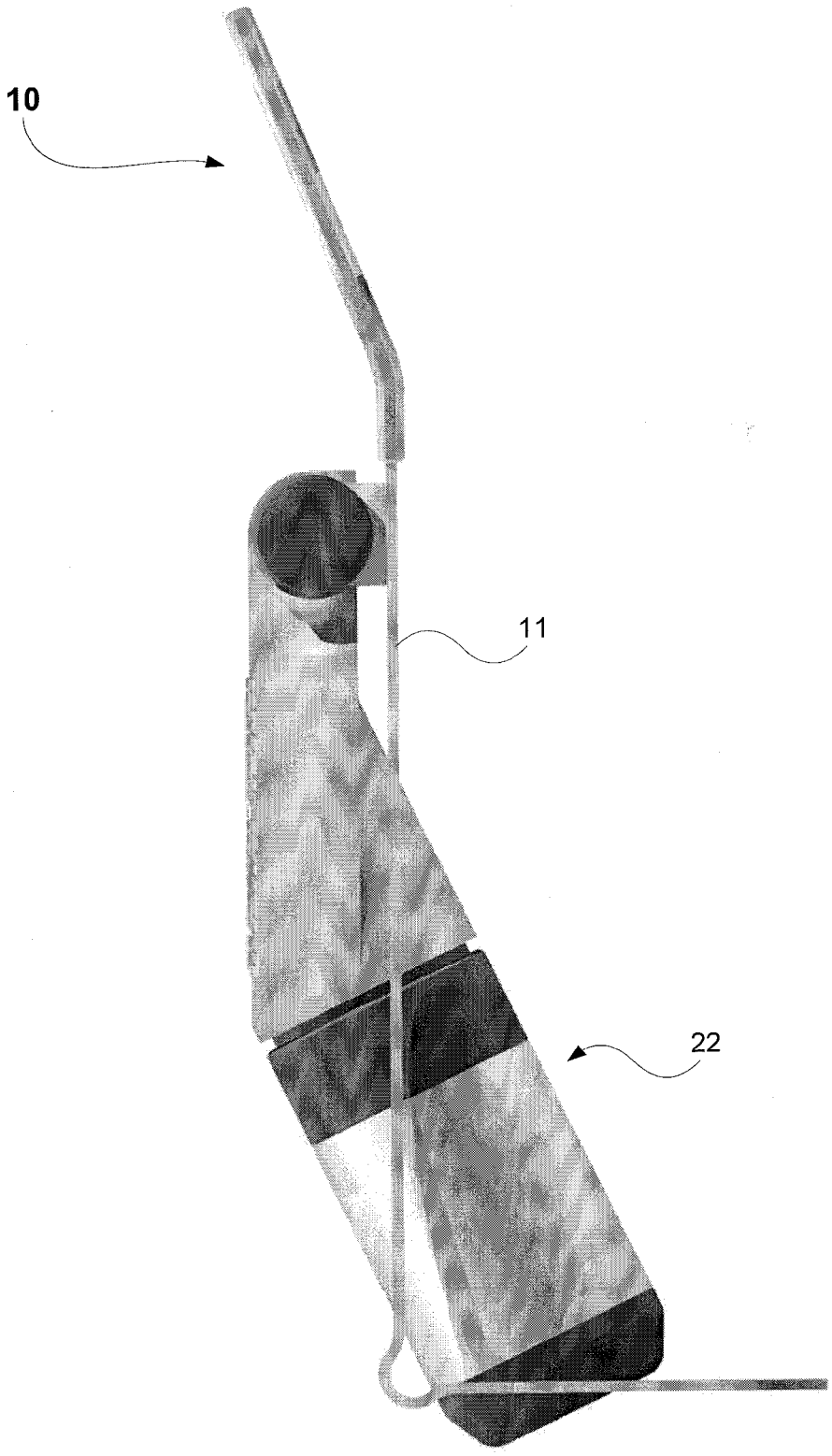
FIG. 11 is perspective view of the device of FIG. 1 with the leg in the retracted position.

The support frame 11 has an aperture 14 extending part of the vertical section 13 and part of the base portion 12. The aperture 14 enables the lower part 22 of the leg 20 to pass through the aperture 14 when the leg 20 is pivoted towards the support frame 11 into a retracted position as depicted in FIG. 11.

An integrated hook 30 extends from the top of the vertical section 13 of the support frame 11. Preferably, the hook 30 is "C" shaped and is coated with rubber to prevent abrasion or scratching with an object that it is hung onto. The hook 30 is angled slightly backwards relative to the vertical section 13 at 157.5°. This makes it ideal for hanging the device 10 at a parallel to a vertical surface such as a wall, using the hook 30). The hook 30 also allows the device 10 to be hung on many articles for easy storage and retrieval. The total height of the device 10 from the base portion 12 to the top of the hook 30 is 160.5 mm. The width of the device 10 is 46.6 mm.

The support frame 11 and leg 20 are made from stainless steel which provides strength, durability and prevents rust.

The device 10 may be used to prevent a self-closing door from closing. It will also prevent any door from being opened. Therefore the device 10 also functions as a portable security device to prevent someone opening a closed door if the base portion 12 of the device 10 is inserted beneath the closed door and the height of the leg 20 is appropriately adjusted to engage with the ground. In such circumstances, the device 10 functions as a portable and convenient security lock to a certain degree.

Although stainless steel has been described, it is envisaged that other materials with similar properties may be used.

Although a rubber foot 23 has been described, it is envisaged that other resilient deformable materials may be used for the foot 23.

It will be appreciated by persons skilled in the art that numerous variations and/or modifications may be made to the invention as shown in the specific embodiments without departing from the scope or spirit of the invention as broadly described. The present embodiments are, therefore, to be considered in all respects illustrative and not restrictive.

I claim:

1. A portable device for preventing movement of a door, the device comprising:

an L-shaped support frame comprising a vertical portion and a base portion, the vertical portion and the base portion being substantially planar;

a hardened bent area defined on the support frame at a position where the vertical portion and the base portion meet to increase a strength of the support frame;

a continuous aperture defined within the vertical portion and the base portion of the support frame; and a leg pivotally connected to the vertical portion of the support frame, the leg having an upper portion connected to a lower portion of the leg at an obtuse angle, and at least the lower portion of the leg is movable to a retracted position by movement through the aperture to abut against the base portion;

wherein a height of the leg is adjustable relative to the ground by manual finger rotation of an exterior tubular member surrounding the lower portion of the leg, and an embedded screw within the exterior tubular member that is in screw engagement with an internal screw thread within the upper portion of the leg for enabling incremental movement of the exterior tubular member relative to the leg; and wherein a distal end of the lower portion of the leg is made to contact the ground when at least part of the base portion is in contact with a bottom surface of the door in order to prevent movement of the door.

2. The device according to claim 1, wherein the angle is about 154° .

3. The device according to claim 1, wherein the leg is pivotally connected to the support frame at a pivot point, the leg being movable relative to the support frame about the pivot point.

4. The device according to claim 1, further comprising an integrated hook extending from the top of the support frame, the hook being coated with rubber to minimise scratching with an object onto which the hook is hung.

5. The device according to claim 1, wherein the distal end of the lower portion of the leg is covered by a rubber foot to increase friction between the leg and the ground.

6. The device according to claim 5, wherein the rubber foot has a plurality of rubber fins extending inwardly from a circumferential peripheral edge of the rubber foot, the rubber fins interacting with a rail that runs along a length of the lower portion of the leg to minimise movement of the rubber foot after the height of the leg relative to the ground has been adjusted.

* * * * *